US009795969B2

(12) United States Patent
Lindner et al.

(10) Patent No.: US 9,795,969 B2
(45) Date of Patent: Oct. 24, 2017

(54) SHREDDING DEVICE WITH A SERVICE HATCH

(71) Applicant: Manuel Lindner, Spittal/Drau (AT)

(72) Inventors: Manuel Lindner, Spittal/Drau (AT); Peter Schiffer, Millstatt (AT); Mario Egger, Eisenstratten (AT)

(73) Assignee: Manuel Lindner, Spittal/Drau (AT)

( * ) Notice: Subject to any disclaimer, the term of this patent is extended or adjusted under 35 U.S.C. 154(b) by 488 days.

(21) Appl. No.: 14/496,705

(22) Filed: Sep. 25, 2014

(65) Prior Publication Data

US 2015/0158030 A1 Jun. 11, 2015

(30) Foreign Application Priority Data

Oct. 1, 2013 (EP) ..... 13186953

(51) Int. Cl.

| | |
|---|---|
| ***B02C 18/00*** | (2006.01) |
| ***B02C 18/22*** | (2006.01) |
| ***B02C 13/282*** | (2006.01) |
| ***B02C 18/14*** | (2006.01) |
| ***B02C 18/16*** | (2006.01) |

(52) U.S. Cl.

CPC ..... *B02C 18/2233* (2013.01); *B02C 13/282* (2013.01); *B02C 18/0084* (2013.01); *B02C 18/14* (2013.01); *B02C 18/16* (2013.01); *B02C 2018/162* (2013.01); *Y10T 29/49723* (2015.01)

(58) Field of Classification Search

CPC .... B02C 18/2233; B02C 18/16; B02C 13/282

USPC ..... 241/285.3, 285.2, 222, 224, 225

See application file for complete search history.

(56) References Cited

U.S. PATENT DOCUMENTS

| | | | | |
|---|---|---|---|---|
| 2,756,002 | A * | 7/1956 | Brake | B02C 13/282 241/285.3 |
| 4,000,860 | A * | 1/1977 | Gotham | B02C 18/148 241/222 |
| 6,145,767 | A * | 11/2000 | Hostettler | B02C 4/286 241/135 |
| 6,322,013 | B1 * | 11/2001 | Lima | B02C 7/14 241/259.1 |
| 7,048,215 | B2 * | 5/2006 | Irwin | B02C 18/142 241/236 |
| 7,255,296 | B2 * | 8/2007 | Karlsson | B02C 18/144 241/285.2 |

(Continued)

FOREIGN PATENT DOCUMENTS

| | | |
|---|---|---|
| AT | 3862 U2 | 9/2000 |
| CN | 201098639 Y | 8/2008 |

(Continued)

*Primary Examiner* — Faye Francis

(74) *Attorney, Agent, or Firm* — Moore & Van Allen PLLC; Henry B. Ward, III

(57) ABSTRACT

A shredding device for shredding materials is provided, the shredding device having: a housing, a rotor in the housing, a pusher element which is pivotable about an axis, so that it pushes the material to be shredded towards the rotor, and a service hatch which is mounted on the housing and configured in such a manner that in an open state it exposes a first opening in the housing with access to a rotor and a second opening in the housing with access to the underside of the pusher element when the latter is pivoted upwardly.

15 Claims, 1 Drawing Sheet

(56) References Cited

U.S. PATENT DOCUMENTS

| | | | | |
|---|---|---|---|---|
| 7,600,708 | B2 * | 10/2009 | Karlsson | B02C 18/144 241/242 |
| 8,464,973 | B2 * | 6/2013 | Karlsson | B02C 18/148 241/285.3 |
| 8,690,089 | B1 * | 4/2014 | Ganser, IV | B02C 7/11 241/285.3 |
| 2012/0018555 | A1 | 1/2012 | Schiffer | |

FOREIGN PATENT DOCUMENTS

| | | | |
|---|---|---|---|
| CN | 201433678 | Y | 3/2010 |
| CN | 102755919 | A | 10/2012 |
| DE | 3018056 | A1 | 11/1981 |
| DE | 19700808 | A1 | 7/1998 |
| EP | 1048353 | A1 | 11/2000 |
| EP | 2218508 | A1 | 8/2010 |

* cited by examiner

SHREDDING DEVICE WITH A SERVICE HATCH

FIELD OF THE INVENTION

The present invention relates to a shredding device for shredding material, in particular in the form of waste products, and in particular to a shredding device with a service hatch.

BACKGROUND OF THE INVENTION

Commercial waste, industrial waste, domestic waste, etc., e.g. (hard) plastics, textiles, composites, rubber or waste wood (such as pallets and chipboard), require shredding prior to their final disposal or especially prior to returning them into the recovered substance cycle. Prior art knows single- or multiple-shaft shredders which are loaded, for example, by wheeled loaders, forklifts, conveyors, or manually via a hopper for material feed.

A central element of a conventional shredder is a rotor assembly comprising a rotor being fitted with tear hooks or blades, e.g. with concave milled round cutting crowns. The blades are fixed, for example, by being bolted onto blade carriers, that can be welded into blade recesses or e.g. bolted on, which are machined into the rotor. Shredding the fed material occurs between the blades rotating with the rotor and stationary, i.e. non-rotating counter-blades (stator blades, scraper combs).

The fed material can be pushed in the direction of the rotating rotor, for example, by a pusher element controlled by load-sensing. After being shredded between the rotating blades and the counter blades, the material is discharged through a screen device, which determines the shredding factor according to the screen size, and is conveyed on by a conveyor belt, a screw conveyor, a chain conveyor or an extractor system etc.

Drawer pushers are known in prior art, in particular for a scrap wood shredding machine, which are installed as being mounted on guides. However, these guides foul during the shredding operation, whereby a perfect shredding operation can be disrupted. In addition, the drawer pusher increases the space required by the shredding device. In alternative designs, the pusher element is integrated pivotally entirely or not entirely into the feed and shredding chamber of the shredding device.

Regardless of the design, service activities are in a shredding device to be performed within the machine. Typical service activities include changing the shredding blades at the rotor and cleaning the machine interior space. Access to the machine interior space for extensive cleaning is in prior art possible only after time-consuming disassembly of machine components, such as hydraulic cylinders that move a pusher element or a service hatch. FIG. 1 shows an example of a sectional view through a shredding device 1 known in prior art with a pusher element 2 which with a pivoting motion moves the material to be shredded towards the rotor 3. The shredding device 1 comprises a service hatch 4 in the interior space. In the open state of the service hatch 4, a service person 5 while standing on the floor of the interior space 6 is enabled to perform servicing at the rotor 3, for example, a blade change. The service hatch 4 is hinged at one end to a pivot axle 7 and can be opened by being pivoted about the pivot axle 7. When closed, the service hatch 4 is part of a pusher wall 8 along which the pusher element 2 comprising a pivot arm 2*a* and a pusher surface 2*b* performs its pivotal motion. The disadvantage of this design is that extensive cleaning in the area of the pusher element 2 can be enabled only by elaborate dismantling of individual components, such as hydraulic cylinders (not shown) that move the pusher element 2, or hydraulic cylinders 9 that move the service hatch 4.

In view of the above problems, it is therefore an object of the present invention to provide a shredding device in which servicing is facilitated over known prior art by reducing the required disassembly of components.

BRIEF SUMMARY OF THE INVENTION

The above object is satisfied by a shredding device according to claim 1, i.e. a shredding device for shredding material, comprising a housing, a rotor within the housing and a pusher element which is pivotable about an axle, so that it pushes the material to be shredded towards the rotor. The shredding device of the invention comprises a service hatch which is mounted on the housing and configured in such a manner that in an open state (service mode), it exposes a first opening in the housing with access to the rotor and a second opening in the housing with access to the underside of the pusher element, in particular when the latter is pivoted upwardly in this service mode. The service hatch can in particular be designed such that the first opening does not expose the underside of the pusher element because it is partially defined by one side of the service hatch. In the open state of the service hatch, the first opening can therefore be separated from the second opening by part of the open service hatch.

The solution according to the invention is based on the idea that the first and the second opening formed in the housing of the shredding device can be used for service purposes. Servicing the rotor can thereby occur through the first opening. The second opening enables cleaning the underside of the pusher element and in particular a pusher surface of the latter. Cleaning the underside of the pusher element of the shredding device in particular requires no complicated dismantling of machine components, so that down times for service purposes can be significantly reduced as compared with prior art.

The underside of the pusher element is accessible after the pusher element has prior to opening the service hatch, for example, changed into a service mode in which it has in the housing been moved upwardly, so that at least a part of the second opening is located below the underside of the pusher element. The material to be shredded can in particular be wood, plastic, or textile waste products or other industrial, agricultural, and domestic waste.

By opening the service hatch, in particular the first and the second openings in the housing of the shredding device are formed which both can be used for service purposes. In particular servicing the rotor can be performed through the first opening. It can be designed such that a service person can enter the interior of the housing through it. The second opening enables cleaning the underside of the pusher element and in particular a pusher surface of the latter. This requires no service person entering the interior of the housing of the shredding device. In particular cleaning the underside of the pusher element of the shredding device requires no complicated dismantling of machine components, such as hydraulic cylinders, that are provided for moving the pusher element or the service hatch. Downtimes for service purposes, in particular for cleaning the pusher element, can thereby be significantly reduced over prior art.

The service hatch can be hinged between a first and a second end thereof to a pivot axle and the first opening can extend below the pivot axle and the second opening above the pivot axle. "Below" or "down" and "above" and "up" are used herein and hereinafter in the common sense wherein "below" or "down" are located closer to a center of gravity of an external gravitational field than "above" or "up". The service hatch is, when opening the latter, thereby pivoted about the pivot axle, where the second end can in the closed state of the service hatch be located below the pivot axle, whereas the first end of the service hatch can in the closed state be located above the pivot axle. When opening the service hatch, the second end can then be pivoted to above the pivot axle.

The service hatch can in particular comprise a first portion with the first end and a second portion with the second end, where the first and the second portions transition into one another at the pivot axle and the second portion is in the open state of the service hatch at least for the larger part located above the pivot axle. The service hatch thus designed allows easy operation in which the first and second openings can be provided by an operating procedure in a structurally simple manner. In particular, the second portion can in the open state of the service hatch remain entirely within the housing. Furthermore, at least part of the first portion can in the open state of the service hatch be located outside the housing. In these developments, the service hatch can be positioned such that it is opened by moving at least part of the first portion downwardly. An easy-to-use service hatch is thereby provided which is formed such that of the first and second openings arise for service purposes due to a continuous motion of the service hatch from a closed state to an open state.

According to one development, the service hatch at least in part forms at least part of a pusher wall along which the pusher element is pivotable. Here, the service hatch can in part form a portion of the housing. The pusher surface of the pusher element contacting the material to be shredded during pushing can in every operating mode be pivotable with the pusher element without contacting any walls, in particular the pusher wall. In particular, no guides (guide rails) need to be provided in the interior of the material receiving space (the hopper area) of the shredding device, with which the pusher surface would contact one of the walls along which the pusher element would have to move and which would inevitably foul during operation, thereby preventing flawless operation of the pusher device. The pusher surface of the pusher element can therefore, when contacting the material, exert force upon the material to be shredded, in particular without guidance. By forming the service hatch at least in part as being at least part of a pusher wall, the service hatch can be integrally formed with another functional element of the shredding device such that this functional element (in the form of a pusher wall) can be pivoted away when opening the service hatch, thereby providing space for a service person in the interior of the housing.

When opening the service hatch, the pusher wall is pivoted upwardly as part of the service hatch. This opening procedure there occurs after the pusher element was, for example, pivoted upwardly. Due to the fact that the pusher wall in this development is formed as part of the service hatch, space for a service person is created who thereby gains access in particular to the rotor when the service hatch is opened.

In another embodiment, the pusher element is attached entirely within the housing on a drivable shaft such that it remains completely within the housing during operation. This means in particular that the pusher element, which is via the above-mentioned pusher surface during the pivoting motion towards the rotor in direct contact with the material to be pushed towards the rotor, is not pivoted or otherwise guided towards the exterior of the housing of the shredding device, but during the shredding operation remains entirely within the housing, thereby enabling a substantially enclosed design of the shredding device without any disruption occurring due to waste products to be shredded, for example on guide rails or at sealing points of the housing openings. Alternatively, the shredding device can be designed such that the pusher element is in the course of the pivot motion in part pivoted out of the housing. In the latter case, the pusher element can in the service mode, in which the service hatch is open, at least in part be located outside of the housing.

In general, the housing mentioned in this application can define the inner space of the shredding device defined at least in part by the walls, in which the material to be shredded is introduced and inside which the pusher element pushes the material towards the rotor. This inner space can in particular be such an inner space which can be or is enlarged by superstructures of all types, for example, funnel-shaped structures for material feed.

The drivable shaft can in the above developments be arranged in parallel to the rotor axis. Rotation of the drivable shaft thereby results in a pivotal motion of the pusher element within a certain angle range. The direction of rotation of the pivotal motion of the pusher element advantageously corresponds to the direction of rotation of the rotor, in order to ensure particularly effective pushing of the material to be shredded onto the rotor which is provided with blades or tear hooks.

It is of course understood that the shredding device according to the invention comprises both single-shaft as well as multi-shaft shredders. The shredding device according to the invention is used, for example, for shredding industrial, domestic or agricultural waste and, for example, comprises dimensions in any direction of more than one meter and, for example, a weight of more than 2 t, in particular of more than 10 t.

Furthermore, a method is provided for cleaning a pusher element of a shredding device comprising a housing, a service hatch, a rotor within the housing, and a pusher element. The service hatch is mounted on the housing and configured in such a manner that in an open state it exposes a first opening in the housing with access to the rotor and a second opening in the housing with access to the underside of the pusher element when the latter is pivoted upwardly, where the method comprises the steps of opening the service hatch and cleaning the underside of the pusher element via the second opening. A portion of the service hatch can for opening be moved downwardly outside of the housing. Such cleaning can be performed in particular when changing from shredding one unmixed material to be shredded to another unmixed material to be shredded. Such cleaning can also serve to remove material that is prone to cause jamming.

Further features and exemplary embodiments of the present invention are illustrated in more detail below using the drawings. It is understood that the embodiments do not exhaust the scope of the present invention. It is further understood that some or all features described hereafter can also be combined in other ways.

DESCRIPTION OF THE INVENTION

Figure 1:
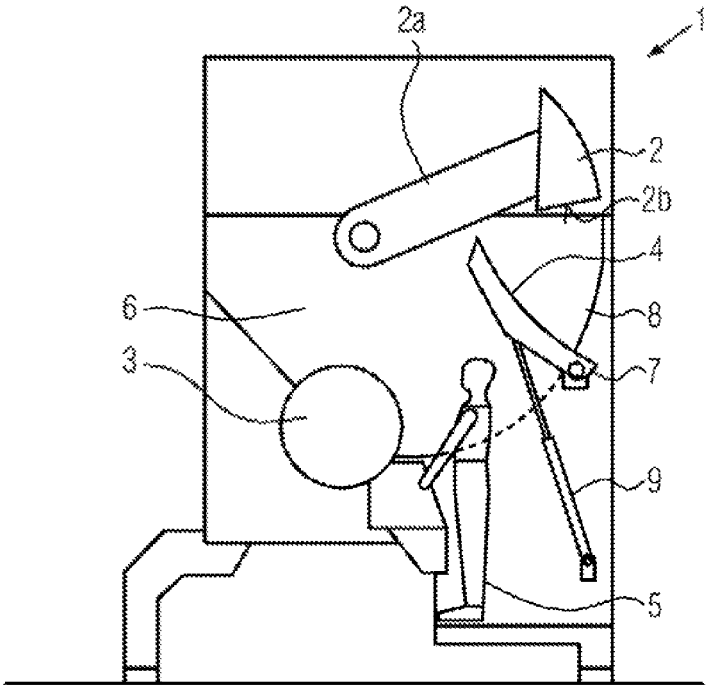
FIG. 1 (PRIOR ART)
FIG. 1 illustrates a cross-sectional drawing of an example of a shredding device comprising a pusher element and a service hatch according to prior art.
Figure 2:
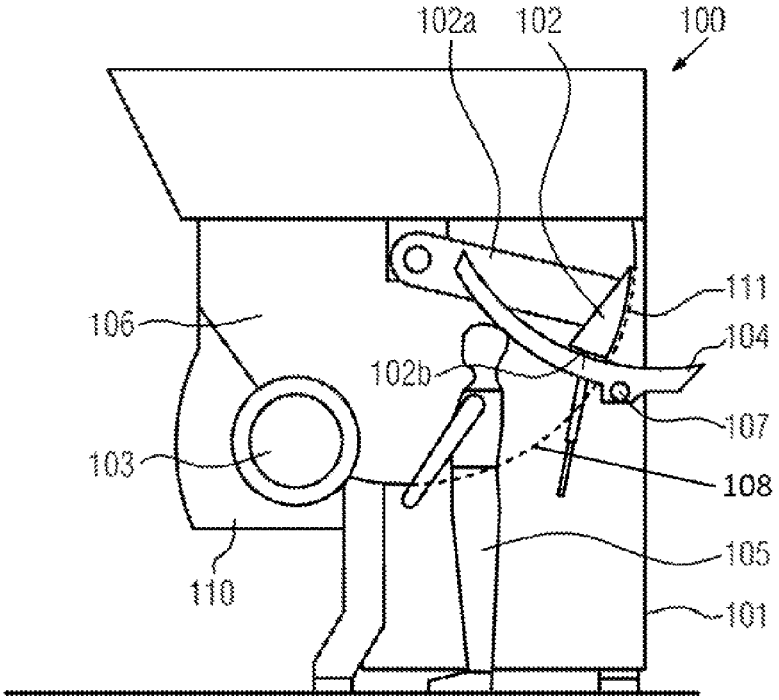
FIG. 2 shows a cross-sectional drawing of a shredding device comprising a pusher element and a service hatch according to one example of the present invention, where the open service hatch provides two openings for service purposes.

As shown in FIG. 2, an exemplary shredding device 100 according to the invention comprises a housing 101, a pusher element 102 having a pivot arm 102*a* and pusher surface 102*b* and a rotor 103. The pusher element 102 is driven by a drivable shaft. The drivable shaft can be connected to a lever mechanism as a part of the drive device on the exterior of the material receiving space of the shredding device. Due to the fact that the lever mechanism is attached outside the material receiving space, it will not be impeded by the material to be shredded, which could interfere with a respective linkage mechanism or even partially block it, if it were installed within the material receiving space. A hydraulic cylinder or pneumatic cylinder can be connected to the lever mechanism and adapted to drive the lever mechanism. Such cylinders represent reliable, relatively inexpensive and easy-to-maintain or removable drive devices. Alternatively, at least one motor drive, in particular a servo motor or a torque motor, can be provided for driving the shaft.

Force can be applied to the material to be shredded via the pusher surface 102*b* of the pusher element 102 perpendicular or substantially perpendicular or at a small angle (approximately 10° to 20°) to the rotor axis of the rotor 103 and along the pivoting motion. The term pusher surface is herein generally referred to as a surface of the pusher element which during operation contacts the material and serves transmission of force onto the material corresponding to the torque of the driven shaft. The waste material to be shredded is thereby pushed by the pusher element 102 onto the rotor 103 and shredded there and ultimately discharged through a screen device 110.

The shredding device 100 comprises a service hatch 104 for servicing. The width of the service hatch 104 can be suitably selected. For example, it extends across the entire width of the housing 101, or only over part of the width of the housing 101, the service hatch 104 can, in particular, be provided as part of the housing 101. In the example shown in FIG. 2, the service hatch 104 in the closed state defines a pusher wall along which the pusher element 102 is pivoted in a contactless manner. In the open state of the service hatch 104 shown in FIG. 2, the pusher wall thus defined is pivoted upwardly, so that a service person 105 gains access to the interior 106 of the shredding device 100 and to the rotor 103 via the resulting first opening 108. In the open state of the service hatch 104, a further opening 111 above the open service hatch 104 results according to the invention. The underside of the upwardly pivoted pusher element 102 can through this further opening 111 be cleaned easily without any disassembly of machine elements. By providing this further opening 111, in particular no hydraulic or other drive devices for the pusher element 102 or the service hatch 104 interfere during cleaning of the pusher element 102 via this further opening 111. Such drive devices therefore do not need to be dismantled in a time-consuming manner in order to clean the pusher element 102. It should be noted that, alternatively, the pusher element 102 in the service mode stops in front of the rotor 103. After opening the service hatch 104, it can be moved for servicing.

The service hatch 104 is hinged to a pivot axle 107 about which it can be pivoted. The position of the pivot axle 107 and the associated pivot point of the service hatch 104, respectively, determine the size of the further opening 111 arising when the service hatch 104 is opened. The position of the pivot axle 107 is in the design of the shredding device 100 or the service hatch 104, respectively, to be selected such that a further opening 111 is in the open state of the service hatch 104 provided such that easy cleaning of the underside of the pusher element 102 is enabled, which is covered during operation. In particular, a part of the service hatch 104 separates the first opening 108 through which a service person 105 can access the interior 106 of the housing 101 from the further opening 111, so as to enable at least partial cleaning of the underside of the pusher element 102 only through the further opening 111.

The pivot axle 107 is located between a first left end of the pusher element 102 and a second right end of the pusher element 102. A first portion of the pusher element 102 with the first end in FIG. 2 therefore extends to the left of the pivot axle 107, and a second portion of the pusher element 102 with the second end extends to the right of the pivot axle 107. In the example shown, the second end is in the operating mode of the shredding device 100 (service hatch 102 is closed) located below the pivot axle 107, whereas the first end is in the operating mode located above the same. When opening the service hatch 104, the second portion of the pusher element 102 and the second end of the pusher element 102 are pivoted upwardly in the service mode of the shredding device 100 (service hatch 102 is opened), the second end is then located above the pivot axle 107.

The invention claimed is:

1. Shredding device for shredding material, comprising:
- a housing;
- a rotor in said housing;
- a pusher element which is pivotable about an axis, so that it pushes the material to be shredded towards said rotor; and
- a service hatch which is mounted on said housing and configured in such a manner that in an open state it exposes a first opening in said housing with access to said rotor and in the open state a second opening in said housing with access to an underside of said pusher element when the latter is pivoted upwardly.

2. Shredding device according to claim 1, which said service hatch is hinged between a first and a second end thereof to a pivot axle and said first opening extends below said pivot axle and said second opening extends above said pivot axle.

3. Shredding device according to claim 1, in which in the open state of said service hatch, said first opening and said second opening are separated from each other by a portion of said service hatch.

4. Shredding device according to claim 1, in which said service hatch at least in part forms at least a part of a pusher wall along which said pusher element is pivotable.

5. Shredding device according to claim 4, in which said service hatch in part forms part of said housing.

6. Shredding device according to claim 2, in which said service hatch comprises a first portion with said first end and a second portion with said second end, where said first and said second portions transition into one another at said pivot axle and said second portion is in the open state of said service hatch at least for the larger part located above said pivot axle.

7. Shredding device according to claim 6, in which said second portion in the open state of said service hatch remains entirely within said housing.

8. Shredding device according to claim 5, in which at least part of said first portion is in the open state of said service hatch outside of said housing.

9. Shredding device according to claim 1, in which said first opening is sufficiently large so that a service person can enter said shredding device through said first opening access.

10. Shredding device according to claim 1, in which said second opening is sufficiently large so that said underside of said pusher element can be at least partially cleaned therethrough.

11. Shredding device according to claim 1, in which said service hatch extends across the entire housing width or across part of said housing width.

12. Shredding device according to claim 1, in which said pusher element is attached entirely within said housing to a drivable shaft such that it remains entirely within said housing during operation.

13. Shredding device according to claim 1, in which said pusher element is partially pivotable to the exterior of said housing during operation.

14. Shredding device according to claim 1, in which said shredding device is a single-shaft or a multi-shaft shredder.

15. Method for cleaning a pusher element of a shredding device comprising the steps of:

providing the shredding device comprising the pusher element and a service hatch mounted on a housing of said shredding device and configured in such a manner that in an open state it exposes a first opening in said housing with access to a rotor in said housing and a second opening in said housing with access to an underside of said pusher element when the latter is pivoted upwardly;

opening said service hatch; and cleaning the underside of said pusher element through said second opening.

* * * * *